US008474636B2

(12) United States Patent
Miyazaki et al.

(10) Patent No.: US 8,474,636 B2
(45) Date of Patent: Jul. 2, 2013

(54) TWIST-CUT UNSEALING MECHANISM FOR CONTAINER

(75) Inventors: Akihito Miyazaki, Tokyo (JP); Hiroaki Hayashi, Tokyo (JP); Manabu Hosokawa, Tokyo (JP); Yasuyuki Takeuchi, Tokyo (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 13/147,748

(22) PCT Filed: Feb. 19, 2009

(86) PCT No.: PCT/JP2009/053473
§ 371 (c)(1),
(2), (4) Date: Oct. 18, 2011

(87) PCT Pub. No.: WO2010/095273
PCT Pub. Date: Aug. 26, 2010

(65) Prior Publication Data

US 2012/0024814 A1 Feb. 2, 2012

(51) Int. Cl.
*B65D 51/20* (2006.01)
*B65D 41/32* (2006.01)

(52) U.S. Cl.
USPC ..... 215/253; 215/48; 215/252

(58) Field of Classification Search
USPC ..... 215/253, 48, 252
See application file for complete search history.

(56) References Cited

U.S. PATENT DOCUMENTS 4,620,638 A * 11/1986 Schmidt ..... 215/11.1
5,158,192 A * 10/1992 Lataix ..... 215/48
5,158,213 A * 10/1992 Lataix ..... 222/189.06
5,878,900 A * 3/1999 Hansen ..... 215/50
7,163,527 B2 * 1/2007 Ahlstrom et al. ..... 604/301

(Continued)

FOREIGN PATENT DOCUMENTS

JP 03-212362 A 9/1991
JP 06-23013 A 2/1994

(Continued)

*Primary Examiner* — Mickey Yu
*Assistant Examiner* — Niki Eloshway
(74) *Attorney, Agent, or Firm* — Lucas & Mercanti, LLP; Klaus P. Stoffel

(57) ABSTRACT

Provided is a twist-cut unsealing mechanism in which an operator can surely sense the fact that twist-cutting of a seal member has completed in assembling of spout and cap of such a type that a container is unsealed by twisting and cutting a seal member for the liquid passage of a spout by means of a cap. A twist-cut unsealing mechanism includes both-side protrusions arranged along a virtual circle rounding around the center line of rotation and an abutment protrusion movable relatively to the both-side protrusions along the virtual circle, and is configured so that one of the both-side protrusion and the abutment protrusion for indicating completion of twist-cut is fixed to a spout (2) and the other protrusion is fixed to a cap (3), the both-side protrusion has a sliding surface of gentle slope and a stopper surface of steep slope wherein projection heights of both surfaces are substantially same in the radial direction and both surface are adjacent to each other along a circle, the abutment protrusion can abut against the sliding surface and the stopper surface, and at a position where the abutment protrusion passed the sliding surface in the rotational direction, the relative rotation positions of the spout (2) and the cap (3) is set above the twist-cut completion position of a seal member (15) and within detachment allowance positional range where the detachment of the cap (3) is permitted.

7 Claims, 27 Drawing Sheets

U.S. PATENT DOCUMENTS

| | | | | |
|---|---|---|---|---|
| 2005/0045579 | A1 | 3/2005 | Weiler | |
| 2007/0007227 | A1* | 1/2007 | Fontana | 215/48 |
| 2007/0102446 | A1* | 5/2007 | Vogel et al. | 222/83 |
| 2007/0262045 | A1* | 11/2007 | Hansen | 215/253 |

FOREIGN PATENT DOCUMENTS

| | | | |
|---|---|---|---|
| JP | 2605789 | U | 7/1995 |
| JP | 2000-043908 | A | 2/2000 |
| JP | 2002-211593 | A | 7/2002 |
| JP | 2002-293361 | A | 10/2002 |
| JP | 2004-131086 | A | 4/2004 |
| JP | 2006-027662 | A | 2/2006 |
| JP | 2008-007165 | A | 1/2008 |
| JP | 2009-046184 | A | 3/2009 |

* cited by examiner

TWIST-CUT UNSEALING MECHANISM FOR CONTAINER

CROSS-REFERENCE TO RELATED APPLICATIONS

This application is a 371 of PCT/JP2009/053473 filed Feb. 19, 2009, the contents of which are incorporated herein by reference.

TECHNICAL FIELD

The present invention relates to a twist-cut unsealing mechanism for unsealing a content pouring unit constituted of a spout and a cap and used for a container for accommodating a fluid content.

BACKGROUND ART

An unsealing type of a content pouring unit of a container includes a twist-cut unsealing type constituted of a spout and a cap. For example, a transfusion container is a container filling as its content transfusion such as nutrient and medicament. The medicament is injected into a patient via a catheter. A pouch container made of a flexible pouch container has been developed as a transfusion container. A spout with a closed liquid passage is mounted on the pouring unit of a transfusion container. The spout is covered with a cap to protect and prevent accidental opening of a liquid passage. The spout and cap constitute a spout-cap assembly.

For transfusion operation as a content pouring operation, a cap is dismounted, a pouring port of the spout is opened, and the port is connected to a catheter. The following structures of a spout-cap assembly have been adopted to simplify the transfusion operation and reduce a load on an operator. The structures allow a cap dismount operation to serve at the same time as a spout pouring unit opening operation, as described in conventional techniques of Patent Documents 1 to 4:

Patent Document 1: Japanese PATENT LAID-OPEN 2002-293361

Patent Document 2: Japanese PATENT LAID-OPEN 2002-211593

Patent Document 3: Japanese UTILITY REG. 2605789

Patent Document 4: Japanese PATENT LAID-OPEN 2006-27662

Patent Document 5: Japanese PATENT LAID-OPEN 6-23013

Patent Document 6: Japanese PATENT LAID-OPEN 2004-131086

Patent Document 7: Japanese PATENT LAID-OPEN 2000-43908

DISCLOSURE

Problems to be Solved by the Invention

In Patent Documents 1 and 2, the upper end of a liquid passage of a spout is sealed with a sealing member, and the spout is covered with a cap. At the upper end in the cap, there is provided a vacancy capable of receiving the sealing member of the spout. In the state that the spout is covered with the cap, the sealing member of the spout is fitted in the vacancy of the cap to integrally couple the spout and cap. When the content is to be poured out from the container, it is necessary to dismount the cap. In this dismount operation, as the cap is raised being rotated, since the sealing member is held by the cap, the sealing member is twist-cut from the spout, and the pouring port is opened. However, it is not possible to definitely judge completion of twist-cut of the sealing member. It occurs often, therefore, that the cap is rotated more than necessary.

In the spout-cap assembly described in Cited Document 3, the vertical groove of the sealing member is meshed with the vertical groove of the cap vacancy so that the cap holds the sealing member. The spout is provided with a cam mechanism so that as the cap is rotated, the cam mechanism raises the cap. A vertical relative motion is, therefore, possible between the sealing member and cap. There is therefore a fear that the sealing member is removed from the cap vacancy after twist-cut.

The spout-cap assembly described in Patent Document 4 is provided with a structure of preventing removal of the sealing member from the cap.

It is important to make an operator know completion of twist-cut of the sealing member in order to prevent erroneous operation during unsealing operation. However, the spout-cap assemblies according to the techniques described in Patent Documents 1 to 4 are not provided with means for making an operator know completion of twist-cut of the sealing member so that erroneous operation is likely to occur.

It is therefore an object of the present invention to provide a twist-cut unsealing mechanism for a spout-cap assembly of the type that the sealing member of a liquid passage of a spout is twist-cut by a cap, the mechanism being capable of making an operator surely know completion of twist-cut of the sealing member and preventing erroneous operation of the operation.

Means for Solving the Problem

In order to achieve the object, there is provided a twist-cut unsealing mechanism for a container including a spout mounted on a pouring port of the container and a cap detachably mounted on the spout in which the container is unsealed by twist-cut a sealing member for sealing a liquid passage of the spout by rotation of the cap around a rotation center line; wherein the spout includes the liquid passage in a tubular body, the liquid passage communicating with an inside of the container at a base portion of the tubular body, and an unsealing expression mechanism having the sealing member to be twist-cut and coupling the body of the spout;

the cap includes a tubular wall forming a tubular vacancy and having an open lower end, at least an upper portion of the body of the spout is capable of concentrically fitted in the cap;

the twist-cut unsealing expression mechanism includes a both-side protrusion disposed along a virtual circle around the rotation center line and an abutment protrusion capable of relative motion along the virtual circle, and one of the both-side protrusion and the abutment protrusion is fixed to the spout and the other protrusion is fixed to the cap;

the both-side protrusion includes a gentle sliding surface and a steep stopper surface both having generally the same protrusion height in a radial direction and disposed side by side in opposite directions along the circle;

the abutment protrusion is capable of abutting against the sliding surface and the stopper surface;

at a position where the abutment protrusion passes the sliding surface in a rotation direction, a relative rotation position of the spout and the cap passes a twist-cut completion position completing twist-cut of the sealing member and is at a separation permission position of permitting separation of the cap:

the twist-cut unsealing structure for a container includes a rotation transmission unit capable of abutting against the sealing member of the spout in an upper portion of the tubular vacancy, and a sealing member holding portion capable of accommodating and holding the sealing member of the spout in the upper portion of the tubular vacancy.

The Effects of the Invention

In the invention described in claim 1, the twist-cut unsealing expression mechanism can express the twist-cut completion position of the sealing member. As the abutment protrusion slides on the sliding surface of the gentle slope of the both-side protrusion having at its front and back surfaces a gentle slope sliding surface and a steep slope stopper surface, an operator can indicate in a pseudo manner a state change during twist-cut and twist-cut completion by making the operator know a resistance change.

In this case, if an intermediate state during twist-cut of the sealing member can be provided, the operator can anticipate a twist-cut end stage and can have an operation margin, which is particularly effective for avoidance of an erroneous operation. In order to express an intermediate change in twist-cut and a state change of twist-cut, it is effective to generate an operation resistance change in twist-cut by using the slope.

As illustrated in Patent Documents 5 to 7, a lock mechanism for preventing reverse rotation of the container and a lid member may be used by using an operation protrusion. This lock mechanism uses as an abutment surface the side wall rising upright like a cliff of a wedge protrusion in order to prevent particularly reverse rotation. Although a final state of the container and a lid member can be expressed, an intermediate state change cannot be indicated.

In the invention described in claim 2, if two or more both-side protrusions are provided, a rotation angle between at least one abutment protrusion disposed between the opposing sliding surfaces and the sliding surface is a rotation angle or larger necessary for twist-cutting the sealing member.

In the invention described in claim 3, two or more both-side protrusions are provided. An angle between opposing sliding surfaces about the cap rotation center line is twice or larger than the rotation angle necessary for twist-cut of the sealing member so that twist-cut is ensured.

In the invention described in claim 4, in the twist-cut operation, a rotation angle necessary for separating the cap is set to 45 degrees to 130 degrees. It is therefore possible to twist-cut the sealing member reliably.

In the invention described in claim 5, it is easy to adopt the structure easy to perform engagement and release of the cap and spout.

In the invention described in claim 6, water drip holes and water drip grooves are formed through the cap. It is therefore easy to perform water drip and drying in a washing process.

In the invention described in claim 7, a clearance between an abutment surface of the cap rotation transmission unit and an abutment surface of the sealing member is set very narrow. There is therefore only a small play of the sealing member and position alignment between the rotation transmission unit and the sealing member is secure. Transmission of a rotation force is reliably performed from the rotation transmission unit to the sealing member, and the sealing member is twist-cut reliably.

BEST MODES FOR PRACTICING THE INVENTION

The details of the will now be described with reference to the accompanying drawings, in connection with the best embodiments.

In FIGS. 1 to 6, reference numeral 1 represents a spout-cap assembly.

The spout-cap assembly 1 is constituted of: a spout 2 mounted on a pouring port 5 of a container 4; and a cap 3 covering the spout 2. Between the spout 2 and cap 3, there are provided a twist-cut unsealing expression mechanism 41, an engaging mechanism 42 and a sealing member holding mechanism 43, to be described later. As illustrated in FIGS. 7 to 12, the spout 2 has a container mount 6 and a body 7 communicating with each other. The container mount 6 mounts the spout 2 on the pouring port 5 of the container 5 liquid tightly, and is inserted into the poring port 5 to be bonded to the material of the container 4 at its outer circumference 8.

The body 7 has a liquid passage 11 (FIG. 12) therein, and the liquid passage 11 has a base portion 12 communicating with a liquid passage 13 (FIG. 7) of the container mount 6 to be communicated with the inside of the container 4 via the liquid passage 13. The outer circumference of the body 7 is inserted into a catheter tube (not shown) and is formed with slip preventing steps 14 at four stages. The upper end of the liquid passage 11 is sealed with a sealing member 15, the sealing member 15 couples the body 7 via a thin portion 16, and as the sealing member 15 is twisted around a center line 17 of a relative rotation, the thin portion 16 is twist cut to separate the sealing member 15 from the body 7 and unseal the liquid passage 11. The cap 3 functions as a jig for rotating and twisting the sealing member 15 around the center line 17. The cap 3 is provided with the sealing member holding mechanism 43 for ensuring coupling with the cap 3 and preventing idle relative rotation between the sealing member 15 and cap 3.

A guard flange 30 is disposed just above the container mount 6, and a riding preventing protrusion 85 is formed at opposite ends to prevent the guard flange 30 from riding over each other while a plurality of spouts are transported after manufacture.

As illustrated in FIGS. 13 to 19, the cap 3 has a tubular wall 25 having a tubular vacancy 27 in which at least an upper portion of the spout 2 can be fitted concentrically. The upper end of the tubular vacancy 27 is closed by a ceiling plate 28 adhered to or continuous with the tubular wall 25, and the lower end 29 the tubular vacancy 27 is open. The tubular wall 25 is constituted of an upper small diameter portion 31 and a lower large diameter portion 32 on both sides of a lower shoulder portion 33. Water drip holes 83 are formed through the upper end portion of the tubular wall 25 of the cap 3 (FIG. 14), and water drive grooves 84 (FIG. 17) are formed inside the tubular wall 25.

As described above, the spout-cap assembly 1 is provided with the twist-cut unsealing expression mechanism 41, engaging mechanism 42 and sealing member holding mechanism 43.

The twist-cut unsealing expression mechanism 41 is provided with a both-side protrusion 51 formed on the cap 3 and an abutment protrusion 52 formed on the spout 2. The abutment protrusion 52 cooperates with the both-side protrusion 51 of the twist-cut unsealing mechanism mounted on the cap 3, and demonstrates a function of representing a twist-cut completion position of the sealing member 15. As illustrated in FIGS. 16, 18 and 20, the both-side protrusion 51 is formed on the inner surface of the tubular wall 25 at the position slightly above the lower end 29 of the cap 3, and disposed along a virtual circle 53 (FIGS. 16 and 20) and around a center line 17 including an arc surface of the inner surface of the tubular wall 25, and has a gentle slope slide surface 54 and a steep slope stopper surface 55 having a generally equal protrusion height in a radial direction and disposed side by side in opposing positions along the virtual circle. The abutment protrusion 52 protrudes from the spout 2 along the circle outside in the radial direction. Although the abutment protrusion 52 can abut against the stopper surface 55, the abutment protrusion 52 can slide on and ride over the relatively gentle slope slide surface while being elastically deformed, if the cap 3 is rotated strongly. However, even with this force, the abutment protrusion 52 is unable to ride over the steep stopper surface 55 like almost a cliff. At least two both-side protrusions 51 (four protrusions in FIGS. 16 and 20) are disposed. A distance between the abutment protrusion 52 and the slide surface 54 is preferably set to a rotation angle or larger necessary for twist-cut of the thin portion by rotating the sealing member 15.

Although the rotation angle necessary for twist-cut of the sealing member changes slightly depending upon the material of the spout 2, if polyethylene is used as the material, the rotation angle is about 45 degrees to 130 degrees.

The both-side protrusion 51 is disposed in various ways depending upon the angle at which a twist-cut sense of the sealing member is desired to be obtained or at which rotation of the cap 3 is desired to be stopped. For example, two both-side protrusions 51 are disposed as illustrated in FIG. 21, four both-side protrusion are disposed as illustrated in FIG. 20, or two both-side protrusions are disposed as illustrate in FIG. 22. In correspondence with this, one abutment protrusion 52 is disposed as illustrated in FIG. 21, and two abutment protrusions are disposed as illustrated in FIGS. 20 and 22. The numbers of both-side protrusions and abutment protrusions may be set as desired. If two or more both-side protrusions 51 are disposed, the abutment protrusion 52 is disposed on the side where the both-side protrusions 51 face each other (where the slide surfaces face each other. An angle ($\theta 1$, $\theta 2$, or $\theta 3$ in FIGS. 21 and 22) between the abutment protrusion 52 and the both-side protrusion on the slide surface side is a rotation angle or larger necessary for twist-cut of the sealing member 51, and an angle ($\theta 1+\theta 2$ in FIGS. 21 and $\theta 1+\theta 3$ in FIG. 22) between opposing both-side protrusions 51 is twice the necessary rotation angle or larger. In FIG. 21, it may be $\theta 1=\theta 2$.

The spout 2 is provided with the abutment protrusion 52 of a plate shape of the twist-cut unsealing expression mechanism 41. Namely, the abutment protrusion 52 of a plate shape protrudes from the surface of the body 7 of the spout 2 in a direction perpendicular to the center line 17. The abutment protrusion 52 has a shape that the side of the abutment protrusion 52 on the side facing the center line 17, i.e., the side on the inner side is fixed to the spout 2, and the upper end and outer side wall are exposed. Although the lower end of the abutment protrusion 52 may be exposed, the shape that the abutment protrusion 52 is connected to and fixed to the reinforcing guard flange 56 is preferable if this guard flange exists under the abutment protrusion as in this embodiment.

In the state that the cap 3 is mounted on the spout 2, a height h1 (FIG. 8) from the upper end of the reinforcing guard flange 56 to the upper side 57 of the abutment protrusion 52 is set longer than a distance h2 between the upper surface of the reinforcing guard flange 56 and the lower end of the tubular wall 25 of the cap 3, and although the upper side 57 has a size that the upper side is disposed at the position where the upper side abuts against the both-side protrusion of the twist-cut unsealing expression mechanism 41. However, as illustrated in FIG. 20, a length d3 of the upper side 57 in a diameter direction, and d3 is set shorter than a diameter D1 of the virtual circle 53 where D1=d3+some length t+some length t' so that the abutment protrusion 52 can be disposed inside the circle 53 of the tubular wall 25.

In this embodiment, although the cap 3 is provided with the both-side protrusion 51, and the spout 2 is provided with the abutment protrusion. Conversely in another embodiment, the cap 3 may be provided with the abutment protrusion 52, and the spout 2 may be provided with the both-side protrusion 51. The lower surface of the reinforcing guard flange 56 may be used to transport the spout 2 in a suspending state after manufacture.

As illustrated in FIG. 5, the spout-cap assembly 1 is provided with the engaging mechanism 42. The engaging mechanism 42 allows the cap 3 to cover the spout 2, prevents separation of the spout 2 and cap 3 when the spout 2 and cap 3 are at a rotation angle position not allowing separation of the spout 2 and cap 3, allows separation of the spout 2 and cap 3 when the spout 2 and cap 3 are separated, and applies a resistance against separation of the spout 2 and cap 3. A spout side engaging piece 61 (FIGS. 7 and 8) extending outside in a direction perpendicular to the center line 17 from the spout 2 and a cap side engaging piece 62 (FIGS. 17 and 18) extending inside in a direction perpendicular to the center line 17 from the cap 3 are disposed in a predetermine angle range around the rotation center line 17. The spout side engaging piece 61 and cap side engaging piece 62 have both undercuts 63 and 64 capable of interfering each other in the rotation center line 17 direction, respectively. In the state that the spout 2 and cap 3 are at predetermined relative angle positions, the undercuts 63 and 64 interfere with each other and the undercuts 63 and 64 are at separation suppression positions for suppressing separation of the cap 3 by interference of the undercuts 63 and 64. When the spout 2 and cap 3 are at separation permission positions of relative angle positions different from the separation suppression positions, interference of the undercuts 63 and 64 is released to allow the cap 3 to be separated.

The spout-cap assembly 1 is provided with the sealing member holding mechanism 43.

In this embodiment, as illustrated in FIG. 9, the spout 2 has an outline shape of the sealing member 15 perpendicular to the relative rotation center line 17 constituted of a center portion 71 and an engaging wing 72 extending outside radially. As illustrated in FIGS. 8 and 11, a downward engaging flange 73 extends from the side wall of the center circular tube.

A sealing member holding portion 74 and an abutment portion 75 are disposed near at the upper end of the small diameter portion 31 of the cap 3.

The sealing member holding portion 74 is provided with a holding flange 77 protruding toward the center line 17. Each holding flange 77 engages with the engaging flange 73 extending from the side wall of the sealing member 15 in the sealing member holding portion 74 without being separated. When the cap 3 is mounted on the spout 2, the holding flange 77 engaged overriding the engaging flange 73.

The abutment portion 75 has abutment members 76 facing the side wall of the spout 2 side sealing members 15 and protruding into the tubular vacancy 27 at a 90 degree angular interval around the center line 17. The four abutment members 76 cooperate each other to develop a function like a box nut to hold the sealing member 15 and prevent a relative rotation between the sealing member 15 and cap 3 around the center line 17. A size relation is important between the sealing member 15 and abutment portion 75 when the sealing member 15 is housed in the abutment portion 75, particularly a size relation between the total length of the right and left engaging wings 72 corresponding to the longitudinal length of the sealing member 15 and inner surface of abutment portion 75, is important for effective transmission of twist-cut torque from the abutment portion 75 to the sealing member 15.

Namely, as illustrated in FIG. 23, if a gap d4 is too large between the top surface 82 of the engaging wing 72 and the inner surface 78 of the abutment portion 75 and a strength of the thin portion 16 is too small, there is no member for restricting deformation of the thin portion 16, the thin portion is deformed as illustrated in FIG. 24 and the sealing member 15 is tilted. As a result, the sealing member 15 and abutment member 76 do not face correctly so that rotation torque is not transmitted correctly from the abutment member 76 to the sealing member 15, the twist-cut of the thin portion 16 is unable to be performed smoothly, and the engaging flange 73 is likely to become unreliable in holding the sealing member 15.

In order to solve this problem, as illustrated in FIG. 25, a diameter of the inner surface of the abutment portion is made short or a gap d4 between the top surface 82 of the engaging wing 72 and the inner surface 78 of the abutment portion is made small, preferably is set to 0.3 mm.

In this manner, as illustrated in FIG. 27, the inner surface 78 of the abutment portion 75 abuts against the engaging wing 72 to regulate the posture of the sealing member 15. A rotation torque is therefore transmitted correctly from the abutment member 76 to the sealing member 15, the twist-cut of the thin portion 16 can be performed reliably, and the sealing member 15 can be held by the engaging flange 73 surely.

Since the water drip holes 83 and water drip grooves 84 are formed in the cap 3, drainage after retort processing of the spout-cap assembly 1 becomes good.

When a container manufacture machine covers the spout 2 with the cap 3 of the spout-cap assembly 1, the abutment protrusion 52 of the spout 2 is detected, the sealing member 15 of the spout 2 is correctly fitted in the sealing member holding portion 74 of the cap 3 along a proper direction relative to the cap 3, e.g., along a direction extending to the center angle position (FIGS. 20 and 21) of the sliding surface 54 of the both-side protrusion 51 or along a direction extending at an angle of 90 degrees relative to the symmetry line (the one-dot chain line in the drawing) of the cross section (FIG. 22) of the cap 3. In this manner, the cap 3 can be mounted to make the sealing member 15 of the spout 2 be fitted in the sealing member holding portion 74 of the cap 3*f* the sealing member 15.

When an operator unseals the spout 2 and pours the content liquid from the container 4, the operator rotates the cap 3 around the center line 17 and confirms a change in a resistance while the abutment protrusion 52 rises the sliding surface 54 of the both-side protrusion 51 and a click sound generated when the abutment protrusion drops along the stopper surface 55. In this manner, it becomes possible to know that the thin portion 16 supporting the sealing member 15 is completely twist-cut and the rotation angle is in a range suitable for separating the cap 3.

An operation of the spout-cap assembly 1 structured as above will be described in the following.

A container manufacture machine detects the abutment protrusion 52 of the spout 2 and the both-side protrusion 51 of the cap 3 to position the abutment protrusion 52 at the center of the sliding surface 53 of the protrusion 51 to cover the spout 2 with the cap 3 in the center line 17 direction. In this manner, the sealing member 15 of the spout 2 is fitted correctly in the sealing member holding portion 74 of the cap 3, and the sealing member 15 having each side wall being surrounded by the abutment portion 76 is held being supported by the engaging flange 73. In this case, the cap side engaging piece 62 of the cap 3 is engaged with the spout side engaging piece 61 of the spout 2 by the undercuts 64 and 63 to complete the spout-cap assembly 1.

When the spout-cap assembly 1 is to be unsealed, the cap 3 is rotated relative to the spout 2 around the center line 17. The cap 3 pushes two side walls (85*a* and 85*c* or 85*b* and 85*d* (refer to FIG. 26) of the side walls 85*a* to 85*d* along a tangential direction of the circle of the cap 3 as viewed in plan. The sealing member 15 is therefore rotates around the center line 17 to be twist-cut at the thin portion 16 to unseal the liquid passage 11.

The operator knows a state suitable for separating the cap 3 from an increase in a friction resistance while the abutment protrusion 52 of the spout 2 rises the sliding surface 54 of the both-side protrusion 51 and extinguishment of the friction resistance and generation of a click sound when the abutment portion drops along the stopper surface 55. In this manner, it is possible to separate the cap from the unsealed spout 2. The stopper surface 55 prevents the cap from being rotated excessively, and it is possible to make the operator know that the cap 3 is at the position capable of being separated. In this case, the sealing member 15 in the spout-cap assembly 1 is twist-cut and held in the sealing member holding portion 74 of the cap 3.

According to the present invention, there is provided a twist-cut unsealing mechanism for a spout-cap assembly of the type that a sealing member of a spout liquid passage is twist-cut with the cap, capable of providing easy position alignment of the spout and cap during a cap mount operation, fitting the sealing member in a cap vacancy in a correct posture, and reliably holding the twist-cut sealing member in the cap without dropping the sealing member.

DESCRIPTION OF REFERENCE NUMERALS

Figure 1:
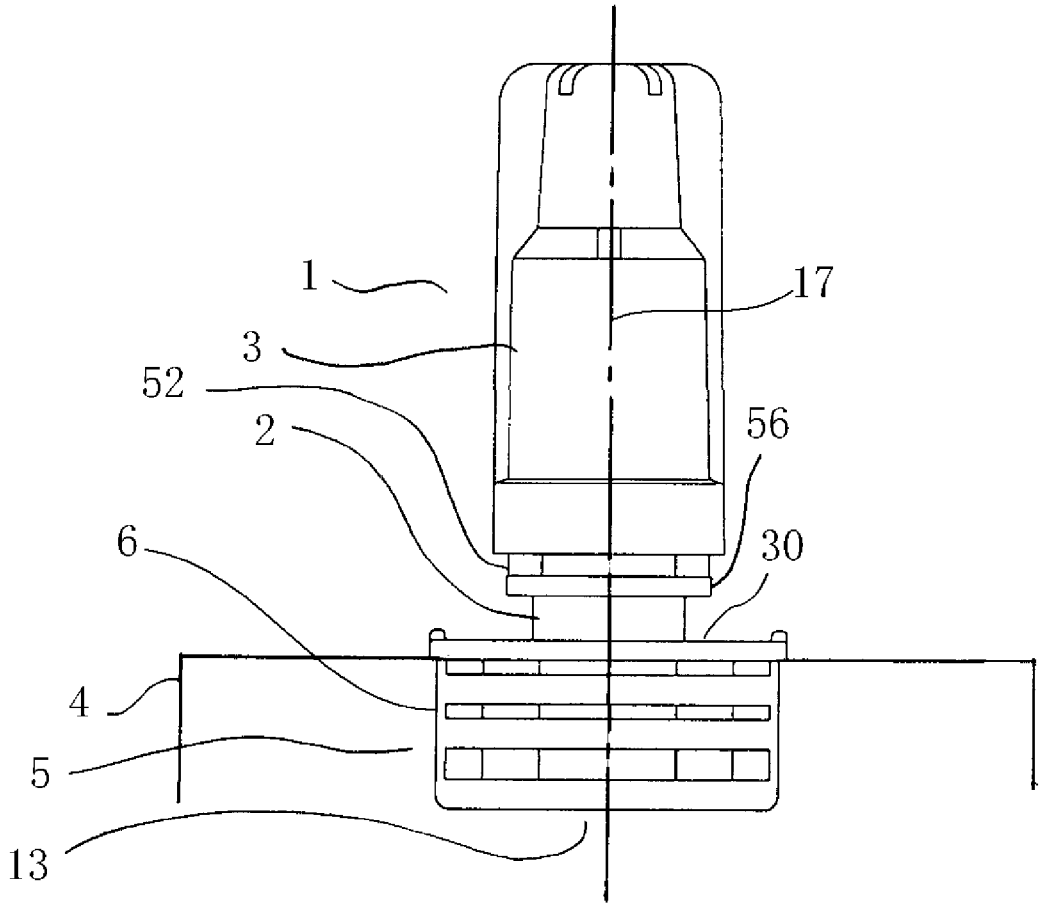
FIG. 1 is a front view of a spout-cap assembly.
Figure 2:
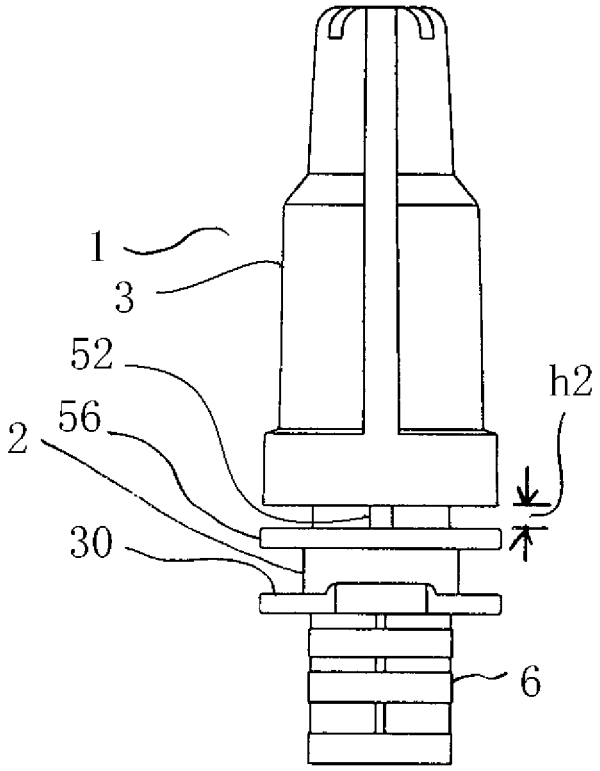
FIG. 2 is a side view of the spout-cap assembly.
Figure 3:
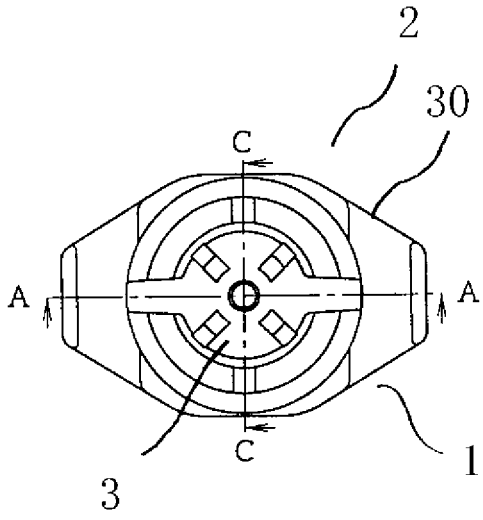
FIG. 3 is a plan view of the spout-cap assembly.
Figure 4:
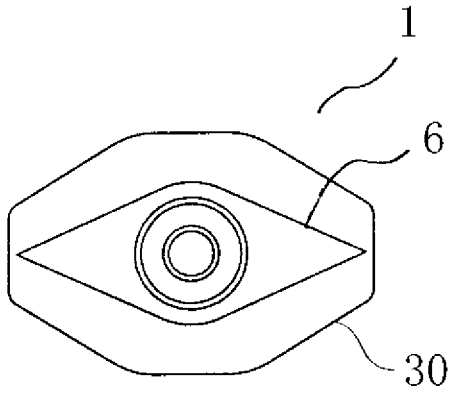
FIG. 4 is a bottom view of a spout-cap assembly.
Figure 5:
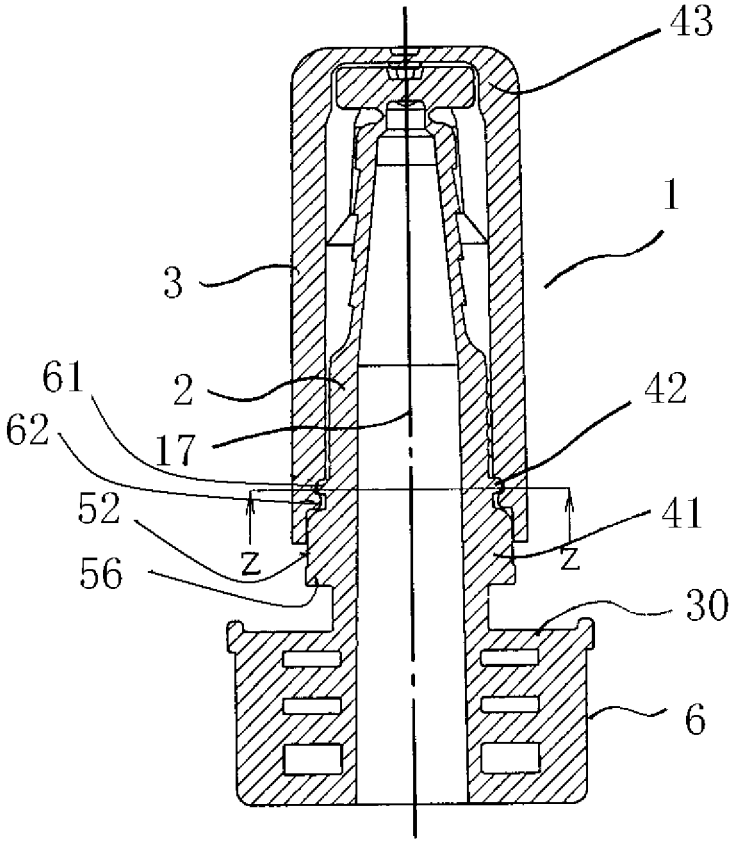
FIG. 5 is a cross sectional view taken along A-A in FIG. 3.
Figure 6:
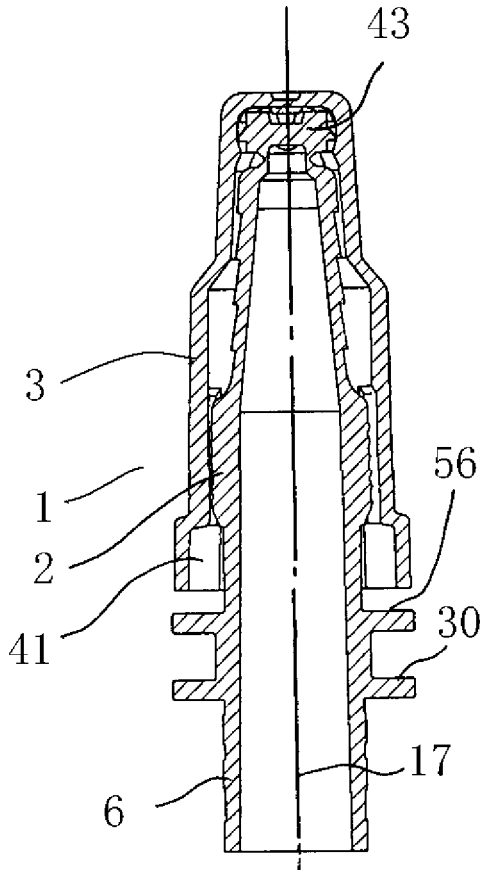
FIG. 6 is a cross sectional view taken along C-C in FIG. 3.
Figure 7:
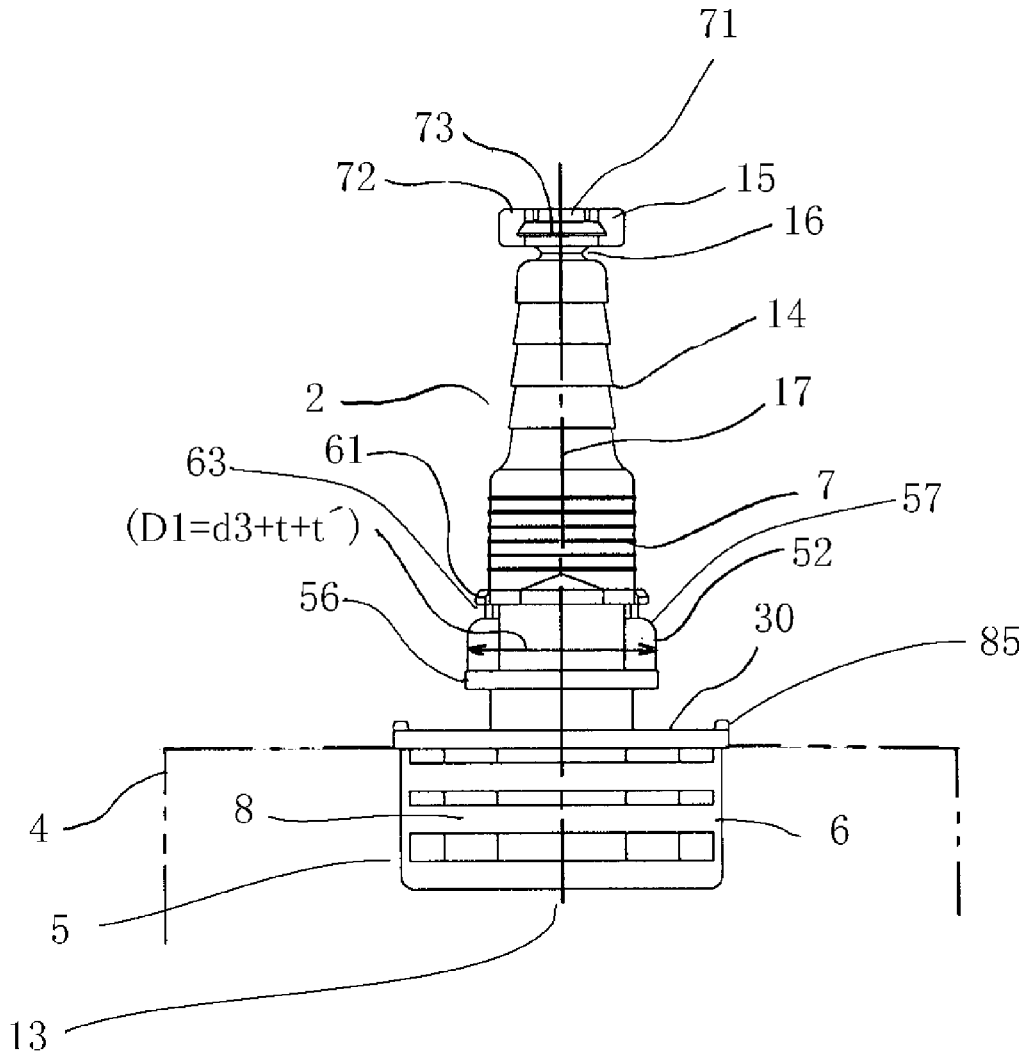
FIG. 7 is a front view of a spout.
Figure 8:
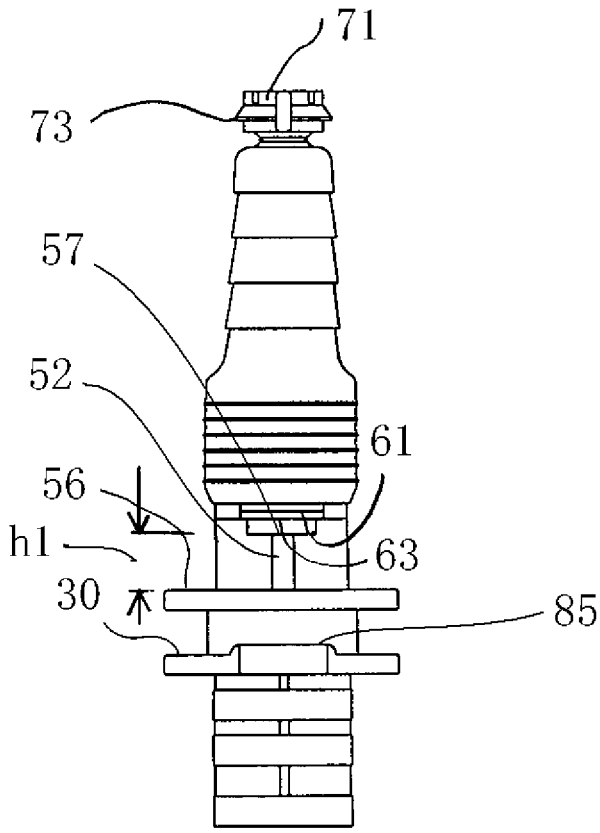
FIG. 8 is a side view of the spout.
Figure 9:
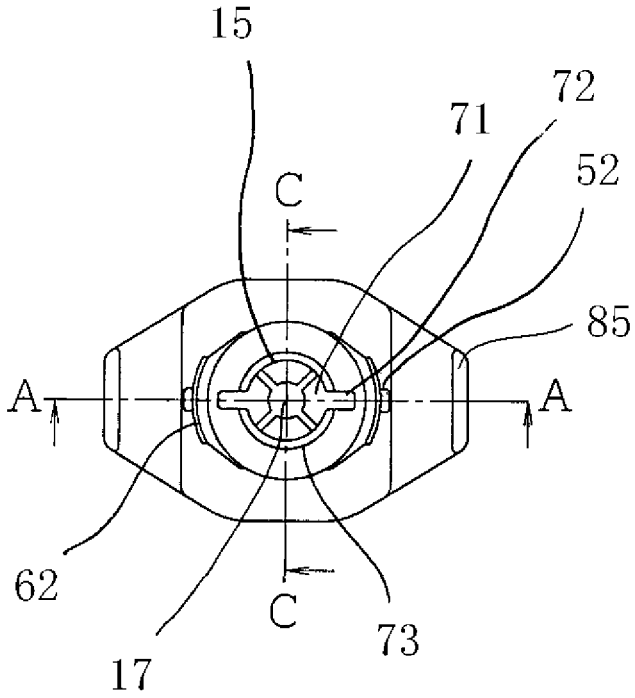
FIG. 9 is a plan view of the spout.
Figure 10:
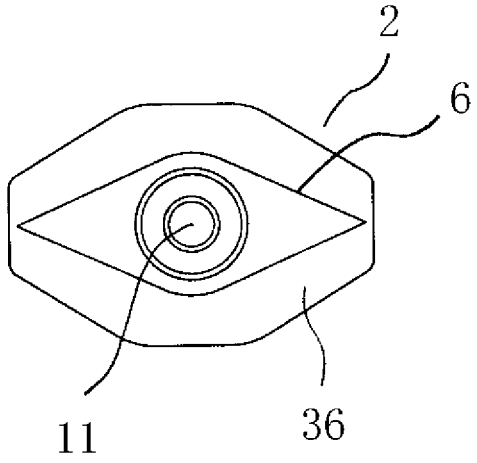
FIG. 10 is a bottom view of the spout.
Figure 11:
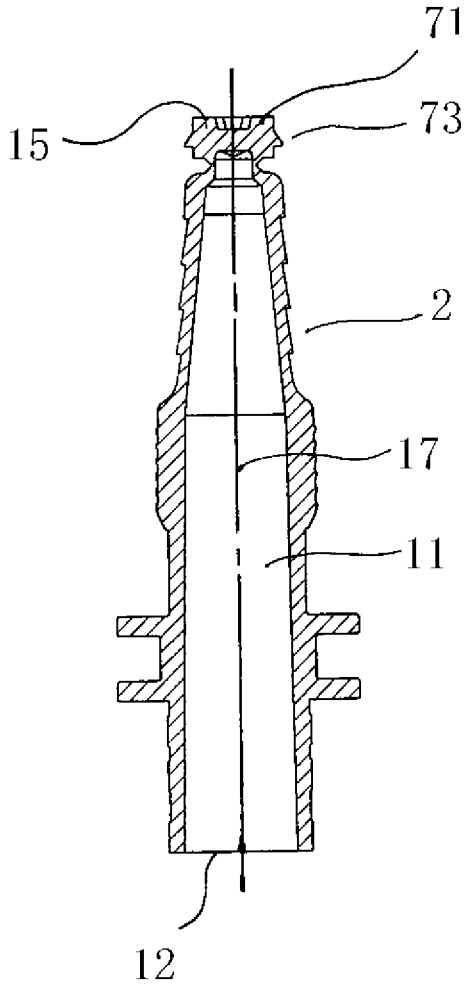
FIG. 11 is a cross sectional view taken along C-C in FIG. 9.
Figure 12:
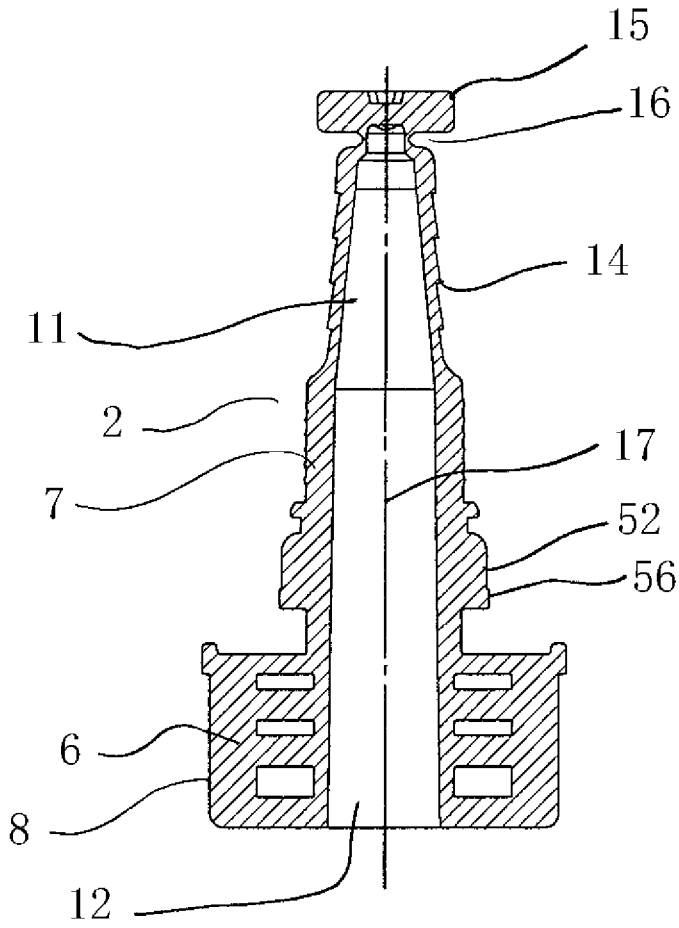
FIG. 12 is a cross sectional view taken along A-A in FIG. 9.
Figure 13:
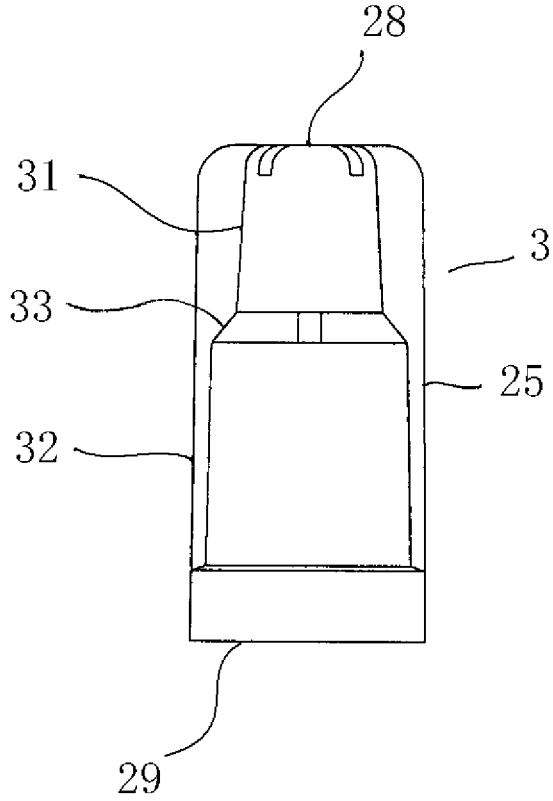
FIG. 13 is a front view of a cap.
Figure 14:
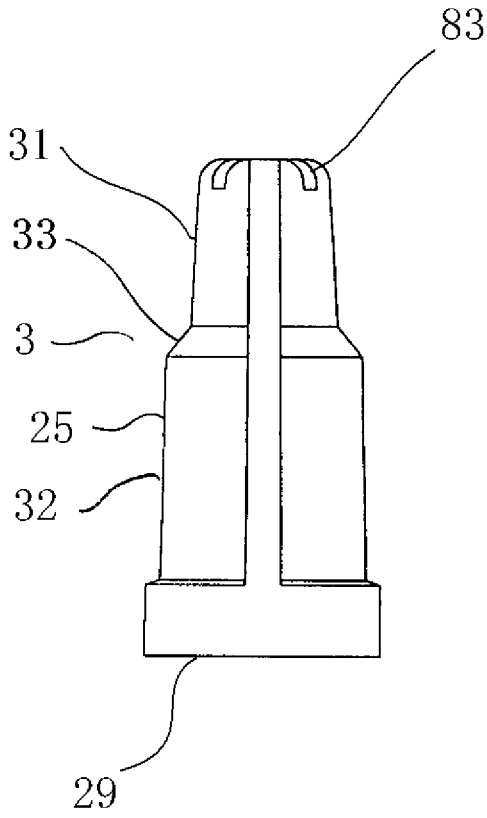
FIG. 14 is a side view of the cap.
Figure 15:
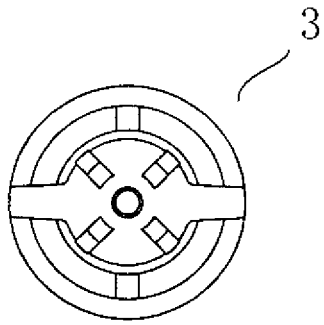
FIG. 15 is a plan view of the cap.
Figure 16:
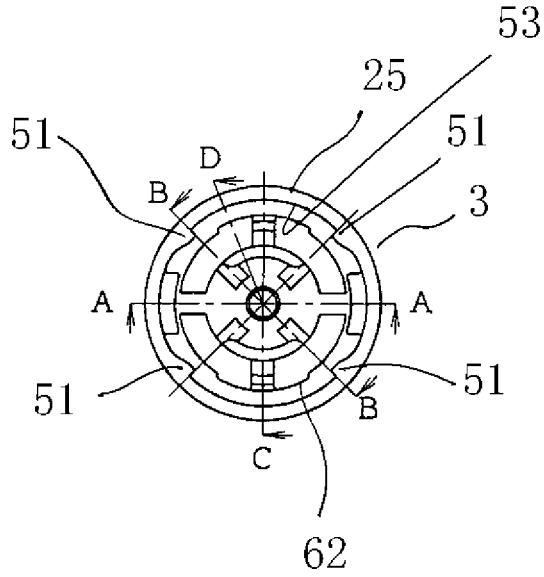
FIG. 16 is a bottom view of the cap.
Figure 17:
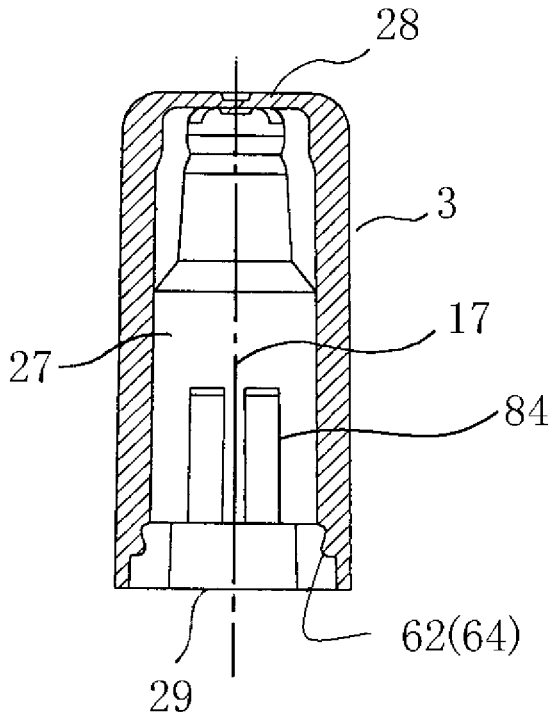
FIG. 17 is a cross sectional view taken along A-A in FIG. 16.
Figure 18:
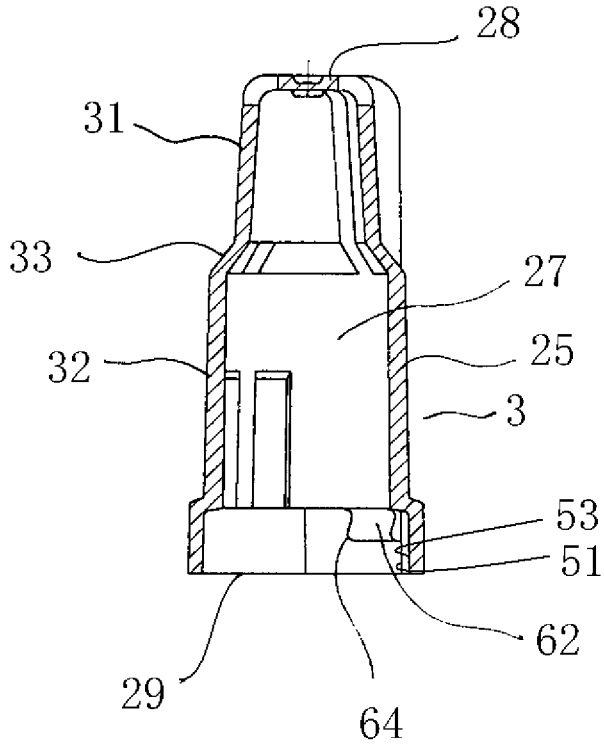
FIG. 18 is a cross sectional view taken along B-B in FIG. 16.
Figure 19:
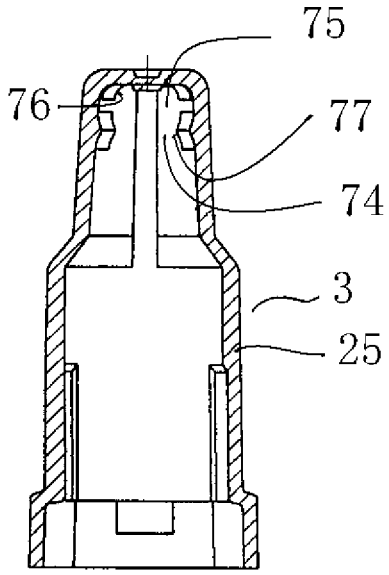
FIG. 19 is a cross sectional view taken along C-O-D in FIG. 16.
Figure 20:
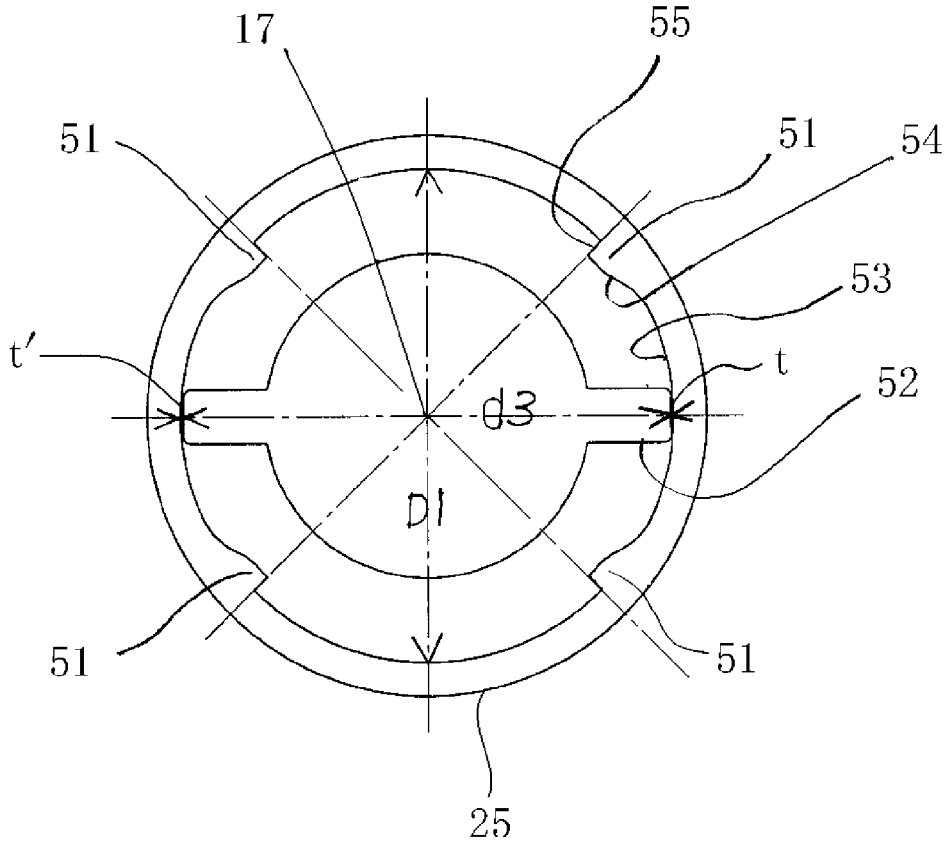
FIG. 20 is an illustrative cross sectional view of a twist-cut unsealing expression mechanism.
Figure 21:
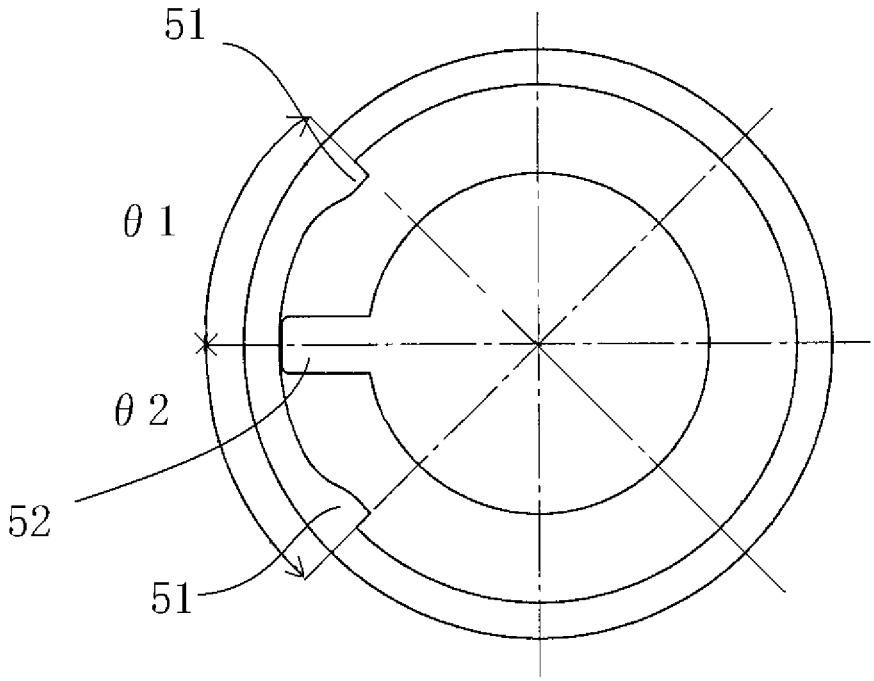
FIG. 21 is an illustrative cross sectional view of another twist-cut unsealing expression mechanism.
Figure 22:
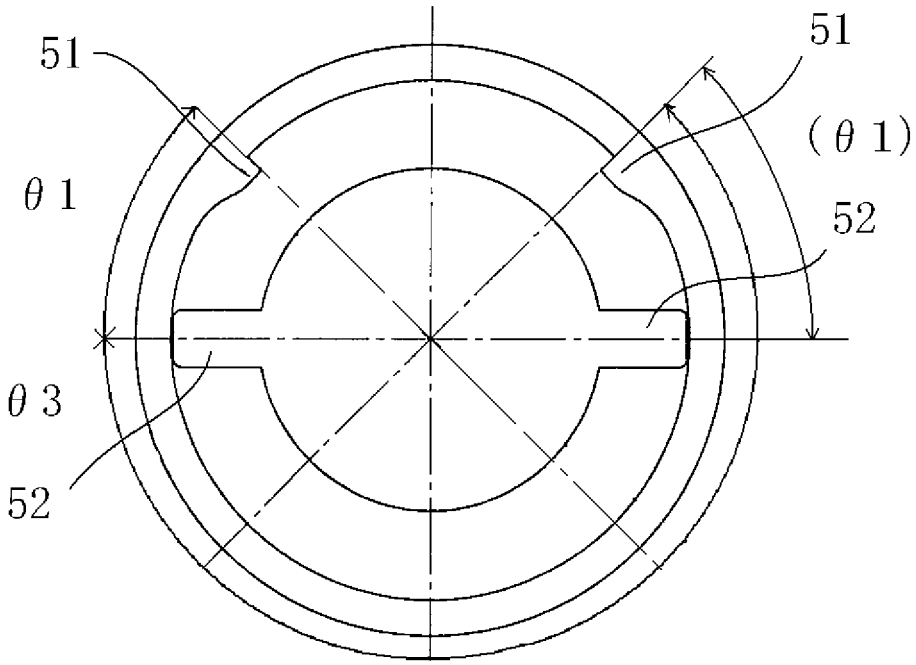
FIG. 22 is an illustrative cross sectional view of another twist-cut unsealing expression mechanism.
Figure 23:
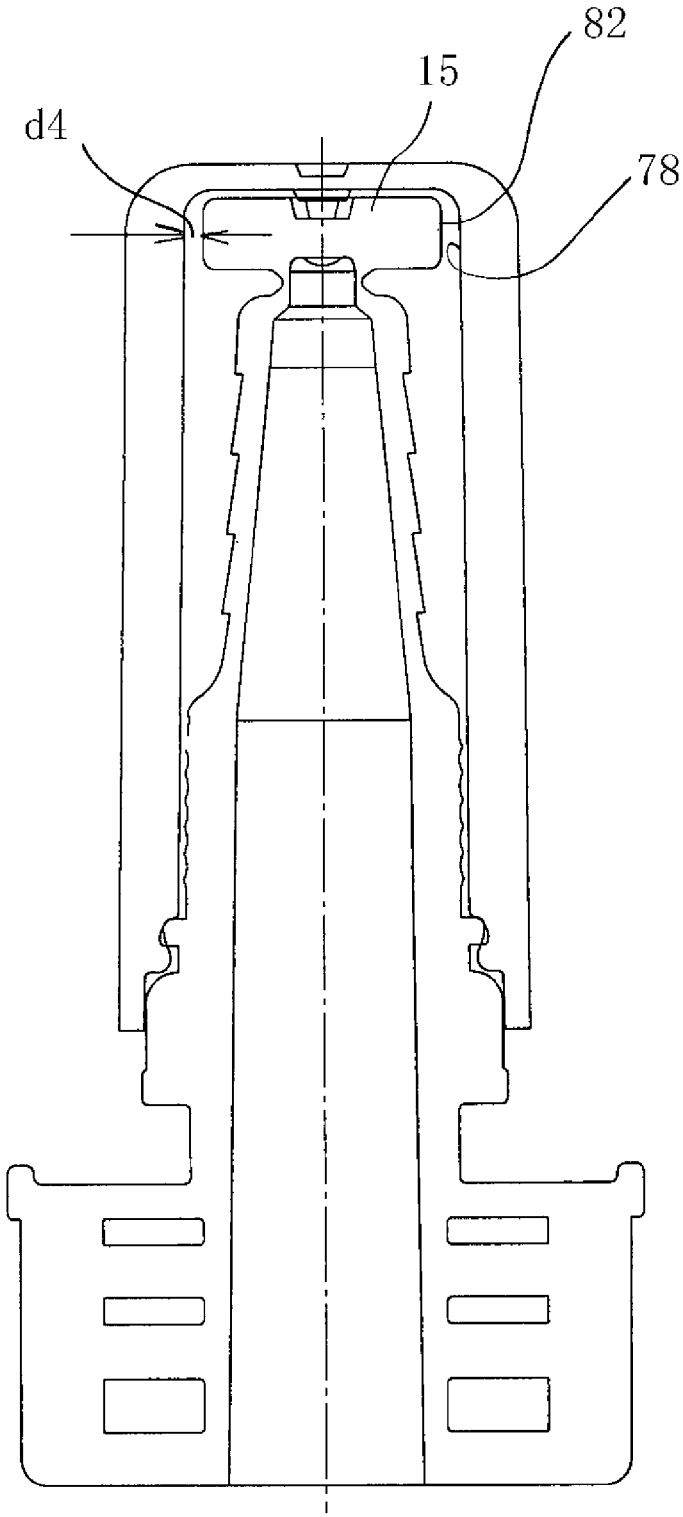
FIG. 23 is a vertical cross sectional view of a spout-cap assembly.
Figure 24:
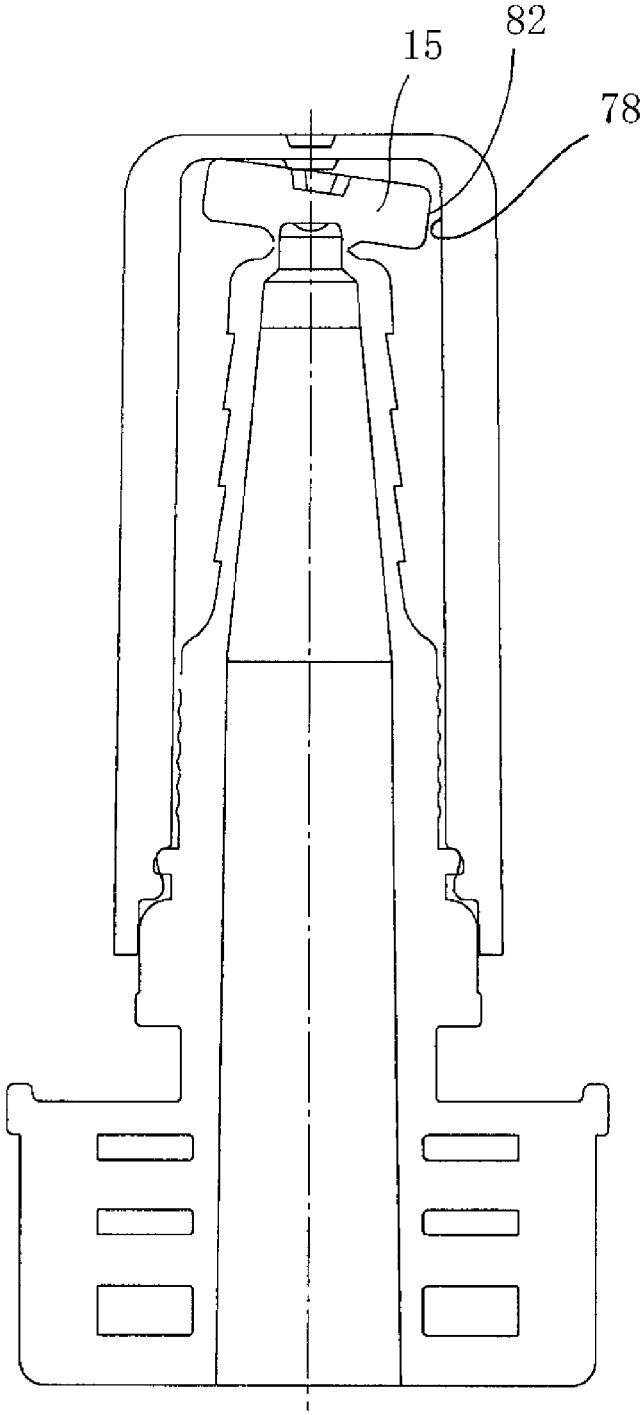
FIG. 24 is a vertical cross sectional view illustrating a state that a sealing member inclines largely.
Figure 25:
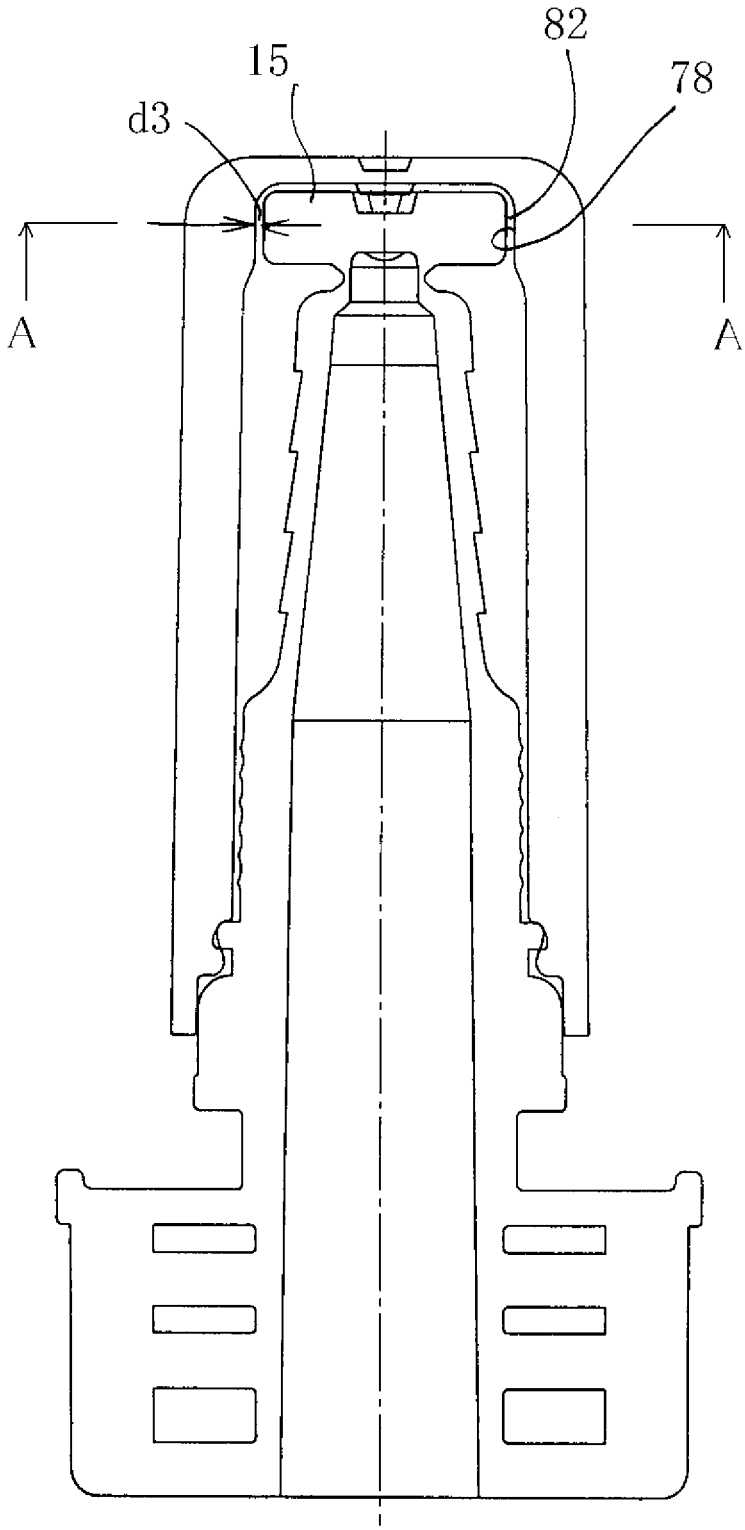
FIG. 25 is a vertical cross sectional view of another spout-cap assembly.
Figure 26:
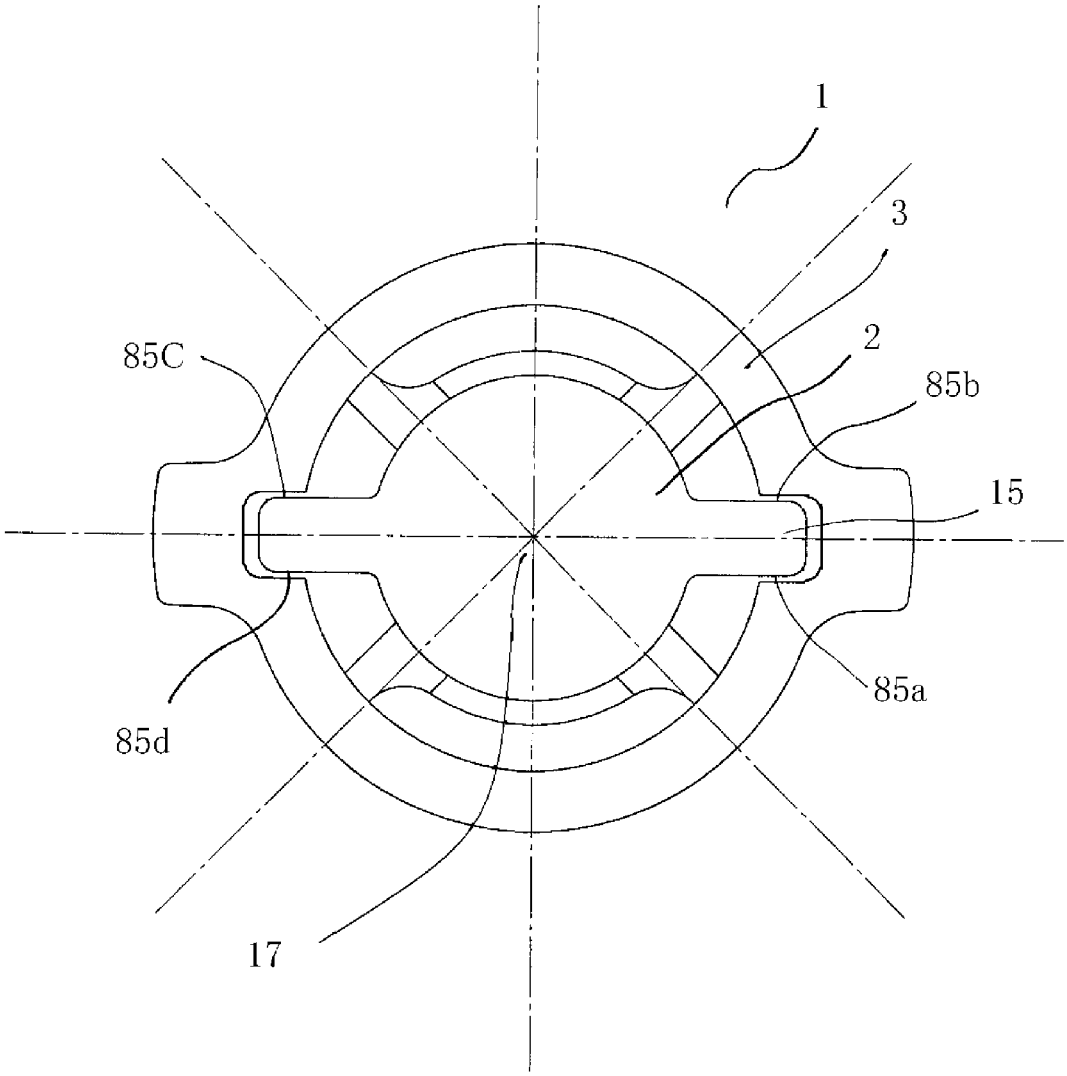
FIG. 26 is a cross sectional view taken along A-A in FIG. 25.
Figure 27:
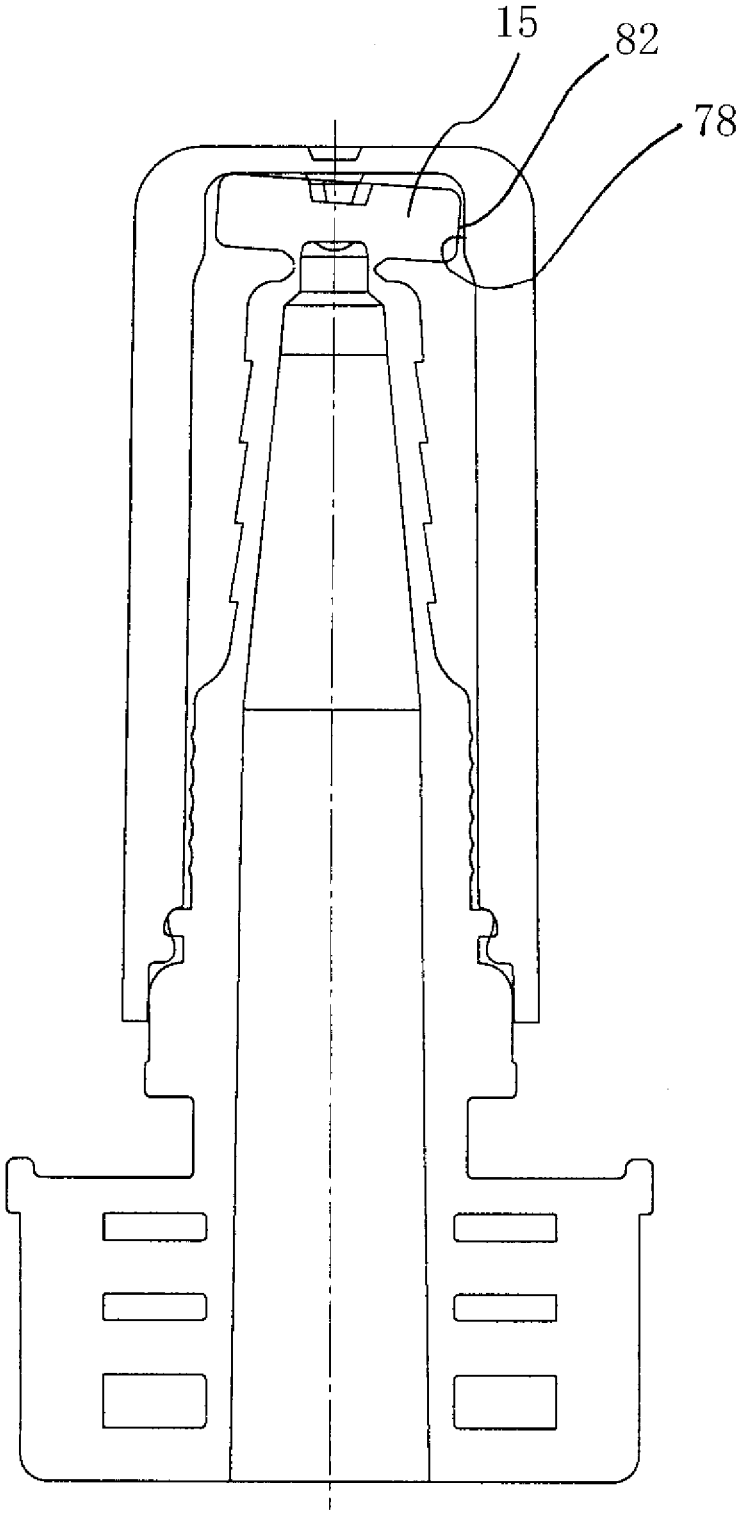
FIG. 27 is a vertical cross sectional view illustrating a state that a sealing member inclines slightly.

1 . . . spout-cap assembly, 2 . . . spout, 3 . . . cap, 4 . . . container, 5 . . . pouring port, 6 . . . container mount, 7 . . . body, 8 . . . outer circumference, 11 . . . liquid passage, 12 . . . base portion, 13 . . . liquid passage, 14 . . . slip preventing step, 15 . . . sealing member, 16 . . . thin portion, 17 . . . center line, 25 . . . tubular wall, 27 . . . tubular vacancy, 28 . . . ceiling plate, 29 . . . lower end, 30 . . . guard, 31 . . . small diameter portion, 32 . . . large diameter portion, 33 . . . shoulder portion, 41 . . . twist-cut unsealing expression mechanism, 42 . . . engaging mechanism, 43 . . . sealing member holding mechanism, 51 . . . both-side protrusion, 52 . . . abutment protrusion, 53 . . . virtual circle, 54 . . . sliding surface, 55 . . . stopper surface, 56 . . . reinforcing guard, 57 . . . upper side, 61 . . . spout side engaging piece, 62 . . . cap side engaging piece, 63 . . . spout side undercut, 64 . . . cap side undercut, 71 . . . center portion, 72 . . . engaging wing, 73 . . . engaging flange, 74 . . . sealing member holding portion, 75 . . . abutment portion, 76 . . . abutment member, 77 . . . holding flange, 78 . . . inner surface, 82 . . . top surface, 83 . . . end surface, 83 . . . water drip hole, 84 . . . water drip groove, 85*a* to 85*d* . . . side surface of sealing member.

The invention claimed is:

1. A twist-cut unsealing structure for a container: wherein the container includes a spout mounted on a pouring unit of the container and a cap detachably mounted on said spout, and the container is unsealed by twist-cutting a sealing member sealing a liquid passage of said spout by rotation of said cap around a rotation center line;

said spout includes said liquid passage in a tubular body, said liquid passage communicating with an inside of said container at a base portion of said tubular body, and an unsealing expression mechanism having said sealing member to be twist-cut and coupling the body of said spout;

said cap includes a tubular wall forming a tubular vacancy and having an open lower end, at least an upper portion of said body of said spout is capable of concentrically fitted in said cap;

said twist-cut unsealing expression mechanism includes a both-side protrusion disposed along a virtual circle around said rotation center line and an abutment protrusion capable of relative motion along said virtual circle, and one of said both-side protrusion and said abutment protrusion is fixed to said spout and the other protrusion is fixed to said cap;

said both-side protrusion includes a gentle sliding surface and a steep stopper surface both having generally the same protrusion height in a radial direction and disposed side by side in opposite directions along said circle;

said abutment protrusion is capable of abutting against the sliding surface and the stopper surface;

at a position where said abutment protrusion passes said sliding surface in a rotation direction, a relative rotation position of said spout and said cap passes a twist-cut completion position completing twist-cut of said sealing member and is at a separation permission position of permitting separation of said cap:

the twist-cut unsealing structure for a container includes a rotation transmission unit capable of abutting against said sealing member of said spout in an upper portion of said tubular vacancy, and a sealing member holding portion capable of accommodating and holding said sealing member of said spout in the upper portion of said tubular vacancy.

2. A twist-cut unsealing structure for a container according to claim 1, wherein there are provided two or more said both-side protrusions, at least one of said abutment protrusions is disposed between opposing said sliding surfaces, and an angle about said center line between said abutment protrusion and said sliding surface is a rotation angle or larger around said rotation center necessary for twist-cut unsealing of said sealing member.

3. A twist-cut unsealing structure for a container according to claim 1, wherein there are provided two or more said both-side protrusions, and an angle between said opposing sliding surfaces around said center line is twice a rotation angle or larger about said rotation center necessary for twist-cut unsealing of said sealing member.

4. A twist-cut unsealing structure for a container according to claim 1, wherein a rotation angle about said rotation center necessary for twist-cut unsealing of said sealing member is 45 degrees to 130 degrees.

5. A twist-cut unsealing structure for a container according to claim 1, wherein an engaging mechanism for applying resistance against separation of said cap is provided between said spout and said cap, said engaging mechanism includes a spout side engaging piece extending outside from said spout in a direction perpendicular to said rotation center line and a cap side engaging piece inside from said cap in a direction perpendicular to said rotation, respectively disposed in a predetermined angle range about said rotation center line, both said spout side engaging piece and said cap side engaging piece have undercuts at top ends capable of interfering along said rotation center line direction, when said spout and said cap are at predetermined relative angle positions, the undercuts are at separation suppressing positions for suppressing separation by interference of the undercuts, and when the said spout and said cap are at separation permission positions at relative angle positions different from the separation suppressing positions for releasing interference of the undercuts to permit separation of the cap.

6. A twist-cut unsealing structure for a container according to claim 1, wherein water drip holes are formed through said tubular wall of said cap, and/or water drip grooves having open lower ends are formed in a lower inner portion of said tubular wall.

7. A twist-cut unsealing structure for a container according to claim 1, wherein a clearance between an abutment surface of said rotation transmission unit and an abutment surface of said sealing member not in a twist-cut unsealing state is 0.3 mm or narrower.

* * * * *